US006927742B2

(12) United States Patent
Chen

(10) Patent No.: US 6,927,742 B2
(45) Date of Patent: Aug. 9, 2005

(54) ELECTROMAGNETIC-INDUCTION SYSTEM WITH OPTIMUM ANTENNA LAYOUT AND THE METHOD FOR FORMING THE SAME

(75) Inventor: Chih-An Chen, Taipei (TW)

(73) Assignee: Aiptek International Inc., Hsin-Chu (TW)

( * ) Notice: Subject to any disclaimer, the term of this patent is extended or adjusted under 35 U.S.C. 154(b) by 25 days.

(21) Appl. No.: 10/387,438

(22) Filed: Mar. 14, 2003

(65) Prior Publication Data

US 2004/0178965 A1 Sep. 16, 2004

(51) Int. Cl.[7] ..... H01Q 21/00; H01Q 7/00

(52) U.S. Cl. ..... 343/867; 343/866; 343/870

(58) Field of Search ..... 343/741, 742, 343/866, 867, 870, 876, 726–729, 855; 342/158, 359, 448; H01Q 21/00, 7/00

(56) References Cited

U.S. PATENT DOCUMENTS

| | | | | | |
|---|---|---|---|---|---|
| 6,154,177 | A | * | 11/2000 | Saito et al. | 343/702 |
| 6,392,610 | B1 | * | 5/2002 | Braun et al. | 343/876 |
| 6,606,068 | B1 | * | 8/2003 | Chao et al. | 343/742 |
| 6,862,018 | B2 | * | 3/2005 | Yeh | 345/173 |
| 2003/0025640 | A1 | * | 2/2003 | Koeberl et al. | 343/728 |
| 2003/0174099 | A1 | * | 9/2003 | Bauer et al. | 343/893 |

* cited by examiner

*Primary Examiner*—Trinh Vo Dinh
(74) *Attorney, Agent, or Firm*—Rosenberg, Klein & Lee

(57) ABSTRACT

This invention utilizes the design rule with minimum path to design the antenna layout so as to reduce the across-line effect, and it also makes changes in antenna address to design the optimum antenna layout. Furthermore, the single connector is also substituted for a plurality of connectors in the present invention to disperse the connected position of each antenna.

24 Claims, 8 Drawing Sheets

ELECTROMAGNETIC-INDUCTION SYSTEM WITH OPTIMUM ANTENNA LAYOUT AND THE METHOD FOR FORMING THE SAME

BACKGROUND OF THE INVENTION

1. Field of the Invention

The present invention relates generally to an electromagnetic-induction system, and more particularly, relates an electromagnetic-induction system with the optimum antenna layout and the method for forming the same.

2. Description of the Prior Art

Because a handwriting recognition system could replace the mouse, and is more suitable than the mouse to let the user input words and patterns by user's hands, improvement of the handwriting recognition system is a hot and important field of current computer technology. The original intention of the handwriting recognition system is to replace the mouse. As usual, to enhance the user's convenience, a handwriting recognition system would usually replace the mouse by both wireless pen and tablet. Herein, the pen nib of the wireless pen usually corresponds to the left button of the mouse. Conventional handwriting recognition systems have been developed for many years, but these products are applied to perform only one function, such as drawing or inputting a word.

In the conventional electromagnetic-induction systems, there are usually a digitizer tablet and a transducer/cursor in the form of a pen or a puck. As is well known, there are two operation modes for determining the position of a pointing device on the surface of a digitizer tablet, wherein one is a relative mode, and the other is an absolute mode. A mouse device operates in a relative mode. The computer sensing the inputs from a mouse recognizes only relative movements of the mouse in X and Y directions as it is slid over the surface on which it is resting. If the mouse is lifted and repositioned on the surface, no change in the signal to the computer will be detected. A common approach uses a sensing apparatus inside the mouse to develop a pair of changing signals corresponding to the longitudinal and transversal movements of the mouse. On the contrary, a cursor device in a digitizer tablet system, such as electromagnetic-induction pen, operates in an absolute mode. If a cursor device is lifted and moved to a new position on its supporting surface, its signal to a computer will change to reflect the new absolute position of the cursor device. Nowadays, various methods have been used to determine the position of a cursor device on the surface of its supporting tablet, wherein one common skill which is applied for the absolute mode is electromagnetic field sensing.

Early transducer/cursors were connected to the tablet by means of a multi-conductor cable through which the position and button/pressure information are transferred virtually without any problem. The cordless transducer/cursors in some of the prior arts have attempted to use frequency and/or phase changes to transmit the non-positional status of the transducer/cursor functions such as buttons pushed, pen pressure, or the like. However, if there is no sophisticated processing, frequency and phase changes are very prone to false reading resulting from several outside factors such as metal objects, noise, wireless electromagnetic wave and so on. These problems become more apparent, especially in a larger digitizer tablet. Improvements have also been made in the prior arts to allow a user to use pointing devices on a digitizer tablet system in dual modes of operation that can provide information of either a relative movement or an absolute position under the control of the user. Usually, a handwriting recognition system is a device with cordless pressure-sensitivity and electromagnetic-induction. Conventional antenna layout for the electromagnetic-induction system is shown in FIG. 1A, each antenna loop 110 having a antenna address is connected with the same connector 120. In general, the pin of each antenna loop 110 is arranged according to the antenna addresses with regulated arrangement, such as X1, X2, X3 . . . , the arrangement table as shown in FIG. 1B, and each antenna loop 110 consists of a plurality of n-type sections, wherein the path of the antenna loop 110 formed by the plurality of n-type sections is extended from the connector 120 until the ground 130 such that the region surrounded the path of the antenna loop 110 takes shape as a region with H-shaped profile. However, this antenna layout makes each antenna loop to go across each other, it is called "across-line effect", such that the antenna layout is designed to be over tight squeeze, as shown in FIG. 1C, and it results in some problems, especially, the noises are substantially raised due to foregoing defects. Furthermore, the product's dimension is shrunk to conform to the requirement of the design rule in the present industry so it is necessary that all devices and the antenna loops in the antenna layout of the electromagnetic-induction system is becoming more and more smaller. Especially, in the antenna layout with multi-loops, its design of loops is becoming disorderly, complex and highly concentrated more and more, such that the across-line effect about these loops is more serious. On the other hand, the peripheral region of the antenna-board is also difficult to be shrunk because all antenna loops are integrated in the same connector. Moreover, when the antenna process for designing the antenna layout with smaller dimension is performed, it is extremely easy to result in the short circuit due to complex across-line design. Therefore, the antenna layout for the electromagnetic-induction system has been difficult to overcome the critical dimension in the antenna process for fabricating the antenna layout with multi-loops, and it would not achieve the subject matter for shrinking the dimension of the antenna layout with multi-loops. In view of the above-mentioned reasons, this invention provides an optimum antenna layout of the electromagnetic-induction system to reduce the across-line effect in the design rule, so as to effectively prevent the various problems resulted from shrink of the antenna layout and strengthen the efficiency of electromagnetic-induction system.

SUMMARY OF THE INVENTION

In accordance with the above description of the skills in prior art, the present invention provides an optimum antenna layout of the electromagnetic-induction system and the method for forming the same to reduce the across-line effect in the design rule and avoid the issue about short circuit resulted from shrink of the antenna layout in the conventional electromagnetic-induction system, so as to improve the across-line design and the efficacy of conventional electromagnetic-induction system.

One object of the present invention is to provide an electromagnetic-induction system with optimum antenna layout and the method for forming the same. The present invention utilizes the design rule with minimum path to design the antenna layout so as to reduce the across-line effect, and the single connector is also substituted for a plurality of connectors in the present invention to disperse the connected position of each antenna, whereby the peripheral region of the printed circuit board (PCB) can be decreased, thus, reducing the production time and achieving the product size reduction target. Accordingly, this invention can prevent the short circuit during shrinking the dimension of the antenna layout and strengthen efficiency of the electromagnetic-induction system. Therefore, the present invention satisfies the economical efficiency and industrial utility.

In accordance with the above description, this invention discloses an electromagnetic-induction system with optimum antenna layout and the method for forming the same. The electromagnetic-induction system of the present invention comprises an antenna loop module, the antenna loop module further comprise a plurality of antenna loops, at least one ground wire and a plurality of first connectors, each antenna loop is coupled with one of the connectors by way of a first pin, and each antenna loop has a minimum path consisting of a plurality of n-type sections, wherein the minimum path is a critical electromagnetic-induction region among the surrounding along the first pin of each antenna loop to the ground wire, and the critical electromagnetic-induction region further comprises a region with h-shaped profile, that is not H-shaped of the skills in prior art. Furthermore, the electromagnetic-induction system of the present invention further comprises a control module, the control module comprises: a plurality of second connectors, and each second connector has a plurality of second pins, wherein the amount of the plurality of second connectors is equal to the amount of the plurality of first connectors, and the amount of the plurality of second pins in each second connector is equal to the amount of the plurality of first pins in each first connector, whereby the antenna loop module can be coupled with the control module; a switch sub-circuit for the antenna loops, the switch sub-circuit is coupled with the plurality of second connectors, wherein the switch sub-circuit comprises a plurality of switches for antenna loops, and each switch is individually coupled with each second pin; a control sub-circuit, the control sub-circuit is coupled with the switch sub-circuit, and the control sub-circuit comprises a firmware, wherein the firmware in the control sub-circuit comprises an antenna-address table with a designated arrangement, so as to control the switch sub-circuit to perform a scanning procedure in accordance with this antenna-address table.

Furthermore, the method for forming the electromagnetic-induction system with optimum antenna layout as described as follows, first of all, an antenna layout procedure is performed by using an optimum program to define the minimum electromagnetic-induction path and the antenna-address of its pin. Next, the designated arrangement is defined in accordance with the plurality of antenna-addresses where the plurality of antenna loops located on. Afterward, a determined step for the switch addresses is performed in accordance with the designated arrangement in the antenna-address table to define the address of each antenna switch. Finally, if the designated arrangement in the antenna-address table is regularity, each antenna switch and each second pin located on the same address are coupled from each other by a first circuit layout; if the designated arrangement in the antenna-address table is irregularity, each antenna switch and each second pin located on the same antenna address are coupled from each other by a second circuit layout. In view of above optimum antenna layout and the method for forming the same, this invention can control the electromagnetic-induction system with optimum antenna layout and the irregular arrangement of the antenna loops.

BRIEF DESCRIPTION OF THE DRAWINGS

The foregoing aspects and many of the attendant advantages of the present invention will become more readily appreciated as the same becomes better understood by reference to the following detailed description, when taken in conjunction with the accompanying drawings, wherein.

DESCRIPTION OF THE PREFERRED EMBODIMENT

What is probed into in the invention is a method for calculating the coordinates of an electromagnetic-inductive system with a multi-antenna loop layout and battery-less pointer device. Detailed steps in production, structure and elements will be provided in the following description in order to make the invention thoroughly understood. Obviously, the application of the invention is not confined to specific details familiar to those who are skilled in electromagnetic inductive system. On the other hand, the common elements and procedures that are known to everyone are not described in the details to avoid unnecessary limits of the invention. Some preferred embodiments of the present invention will now be described in greater detail in the following. However, it should be recognized that the present invention can be practiced in a wide range of other embodiments besides those explicitly described, that is, this invention can also be applied extensively to other embodiments, and the scope of the present invention is expressly not limited except as specified in the accompanying claims.

Figure 2A:
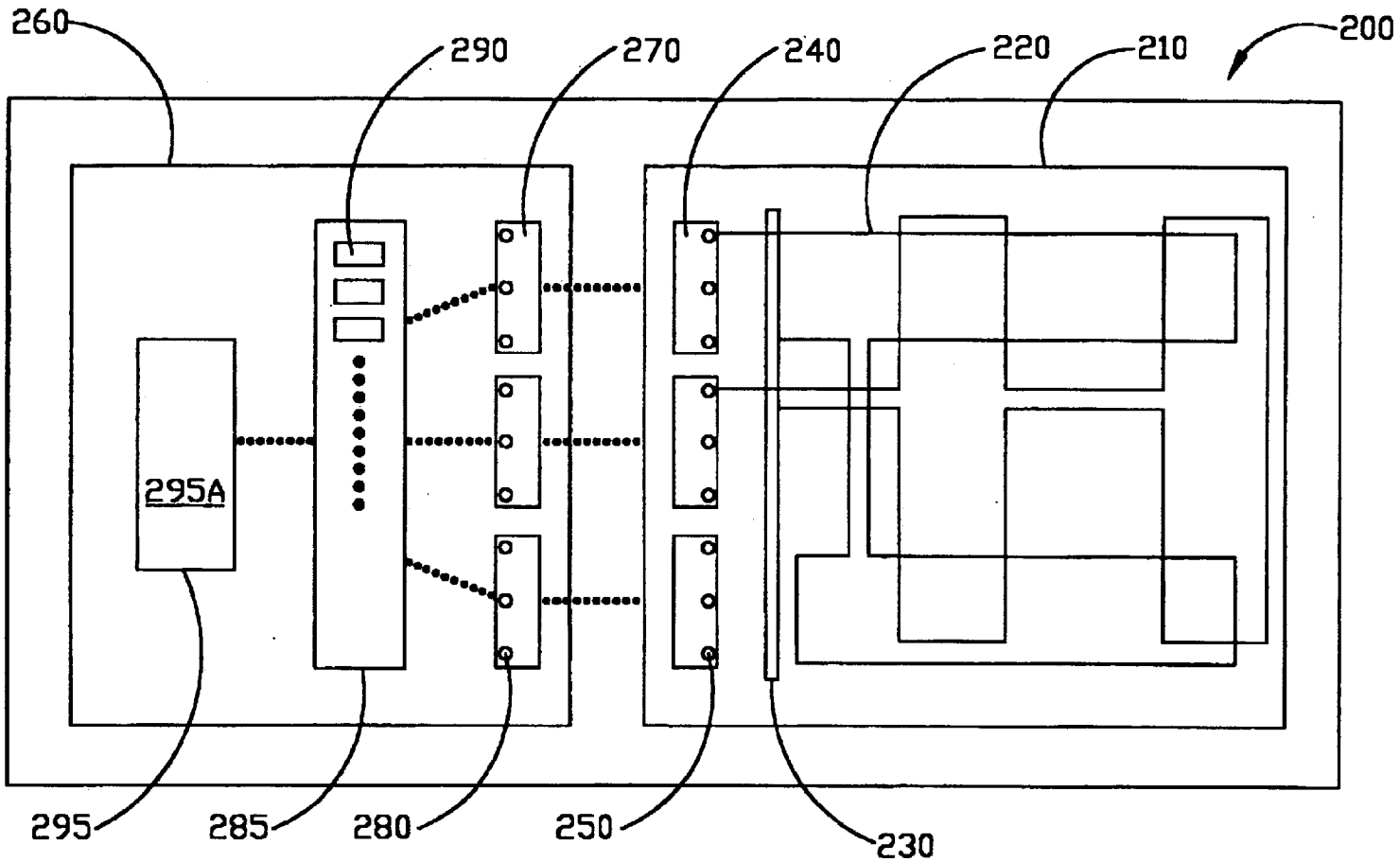
FIG. 2A shows the electromagnetic-induction system with the optimum antenna layout in accordance with one of the preferred embodiment.
Figure 2B:
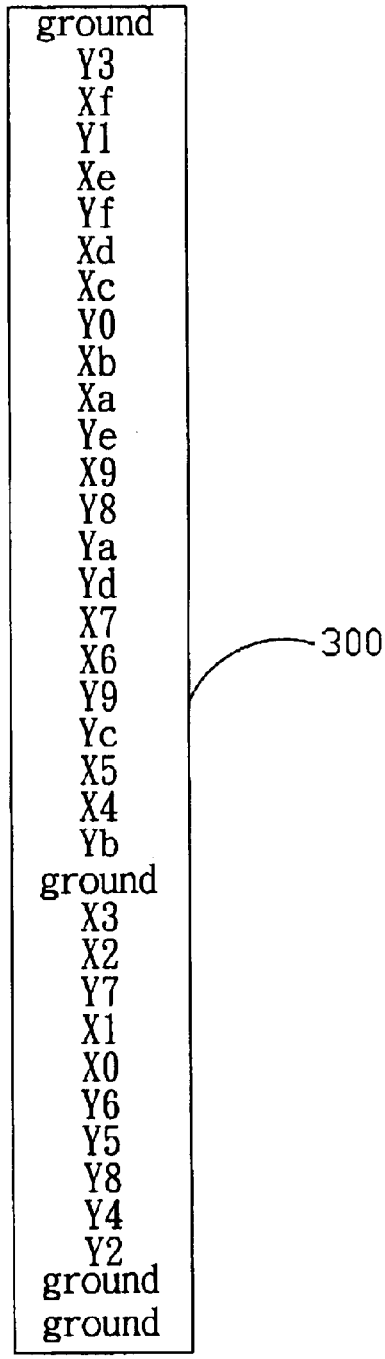
FIG. 2B shows the antenna-address table with a irregular arrangement of the optimum antenna layout of electromagnetic-induction system in accordance with one of the preferred embodiment.
Figure 2C:
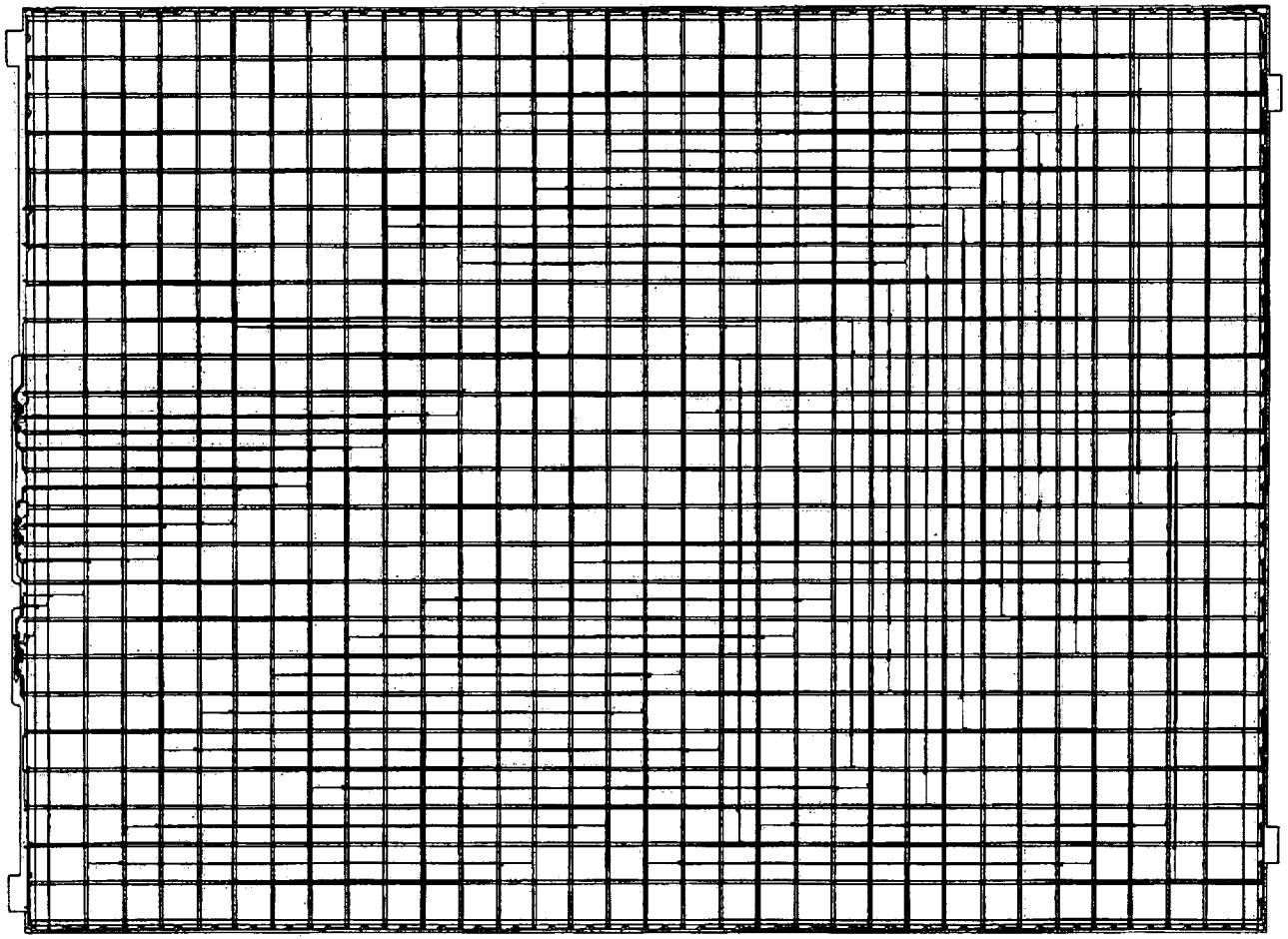
FIG. 2C shows cross-sectional views illustrative of optimum antenna layout having the antenna loop with the h-shaped region of the electromagnetic-induction system in accordance with one of the preferred embodiment.

As illustrated in FIG. 2A, in one preferred embodiment of the present invention, this invention provides an electromagnetic-induction system 200 with the optimum antenna layout, the electromagnetic induction system 200 comprises an antenna loop module 210, the antenna loop module 210 further comprise a plurality of antenna loops 220, at least one ground wire 230 and a plurality of first connectors 240 having a plurality of first pins 250, each antenna loop 220 is formed between the first pin 250 thereof and at least one ground wire 230, and each antenna loop 220 is coupled with one of the connectors 240 by way of the first pin 250 thereof; and further, each antenna loop 220 has a minimum path consisting of a plurality of n-type sections, wherein the minimum path is a critical electromagnetic-induction region among the surrounding along the first pin 250 of each antenna loop 220 to the ground wire 230, and the critical electromagnetic-induction region further comprises a region with h-shaped profile, that is not H-shaped of the skills in prior art. Furthermore, the antenna loop module 210 further comprises a first antenna address, the plurality of first pins 250 are arranged in order in the antenna loop module 210 according to the first antenna address. The electromagnetic-induction system 200 of the present invention further comprises a control module 260 coupled with the antenna loop module 210, the control module 260 further comprises: a plurality of second connectors 270, and a plurality of second connectors 270 have a plurality of second pins 280, wherein the amount of the plurality of second connectors 270 is equal to the amount of the plurality of first connectors 240, and the amount of the plurality of second pins 280 in each second connector 270 is equal to the amount of the plurality of first pins 250 in each first connector 240, whereby the antenna loop module 210 can be coupled with the control module 260; a control sub-circuit 295, and the control sub-circuit 295 further comprises a firmware 295A, wherein the firmware 295A in the control sub-circuit 295 stores an antenna-address table 300 with a second antenna address, wherein the antenna-address table 300 further comprises a designated arrangement as shown in FIG. 2B; a switch sub-circuit 285, the switch sub-circuit 285 is individually coupled with the plurality of second connectors 270 and the control sub-circuit 295, wherein the switch sub-circuit 285 further comprises a plurality of antenna switches 290, and the plurality of antenna switches 290 are arranged in order in the switch sub-circuit 285 in accordance with the first antenna address or the second antenna address, and one by one the plurality of antenna switches 290 are coupled with the plurality of second pins 280 by performing a circuit layout. Furthermore, the control sub-circuit 295 is coupled with the switch sub-circuit 285 to control the plurality of the antenna switches 290 in the switch sub-circuit 285 to perform a scanning procedure in accordance with the antenna-address table 300 stored in the firmware 295A.

Figure 1A:
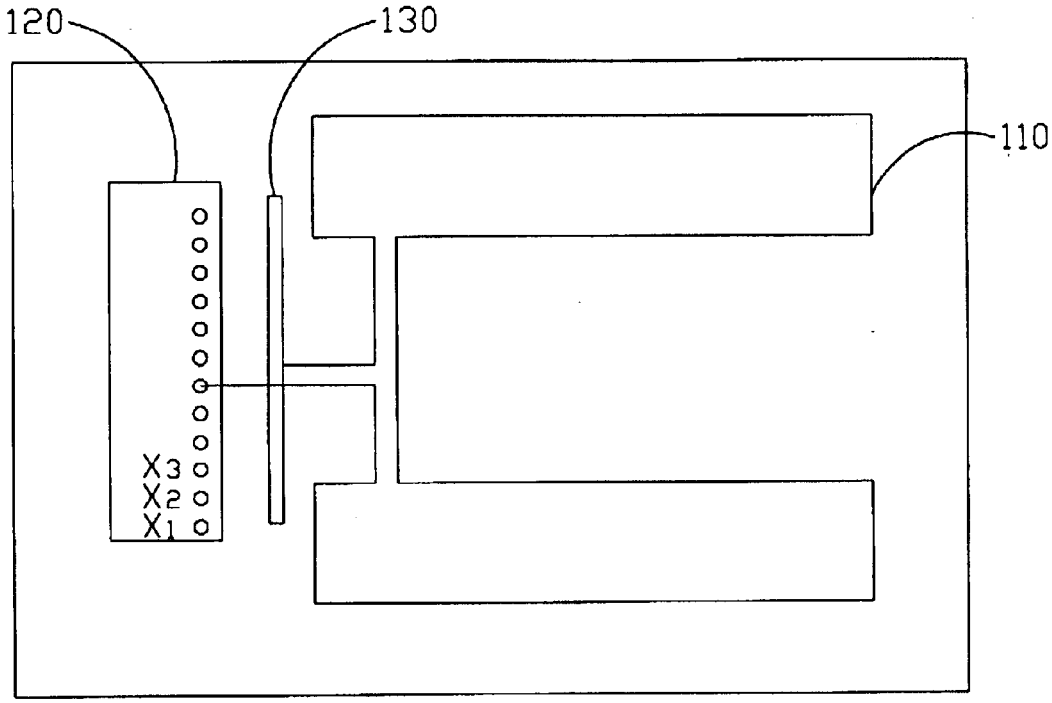
FIG.1A(Prior Art)
FIG. 1A shows cross-sectional views illustrative of the antenna loop with the H-shaped region in conventional electromagnetic-induction system.
Figure 1B:
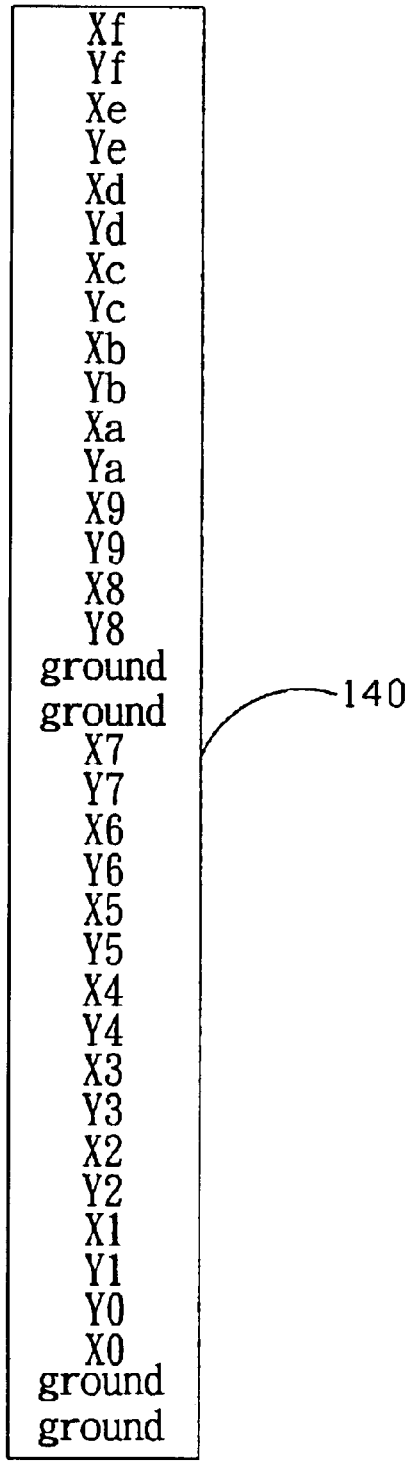
FIG.1B(Prior Art)
FIG. 1B shows the antenna-address table with a regular arrangement of the antenna layout in conventional electromagnetic-induction system.
Figure 1C:
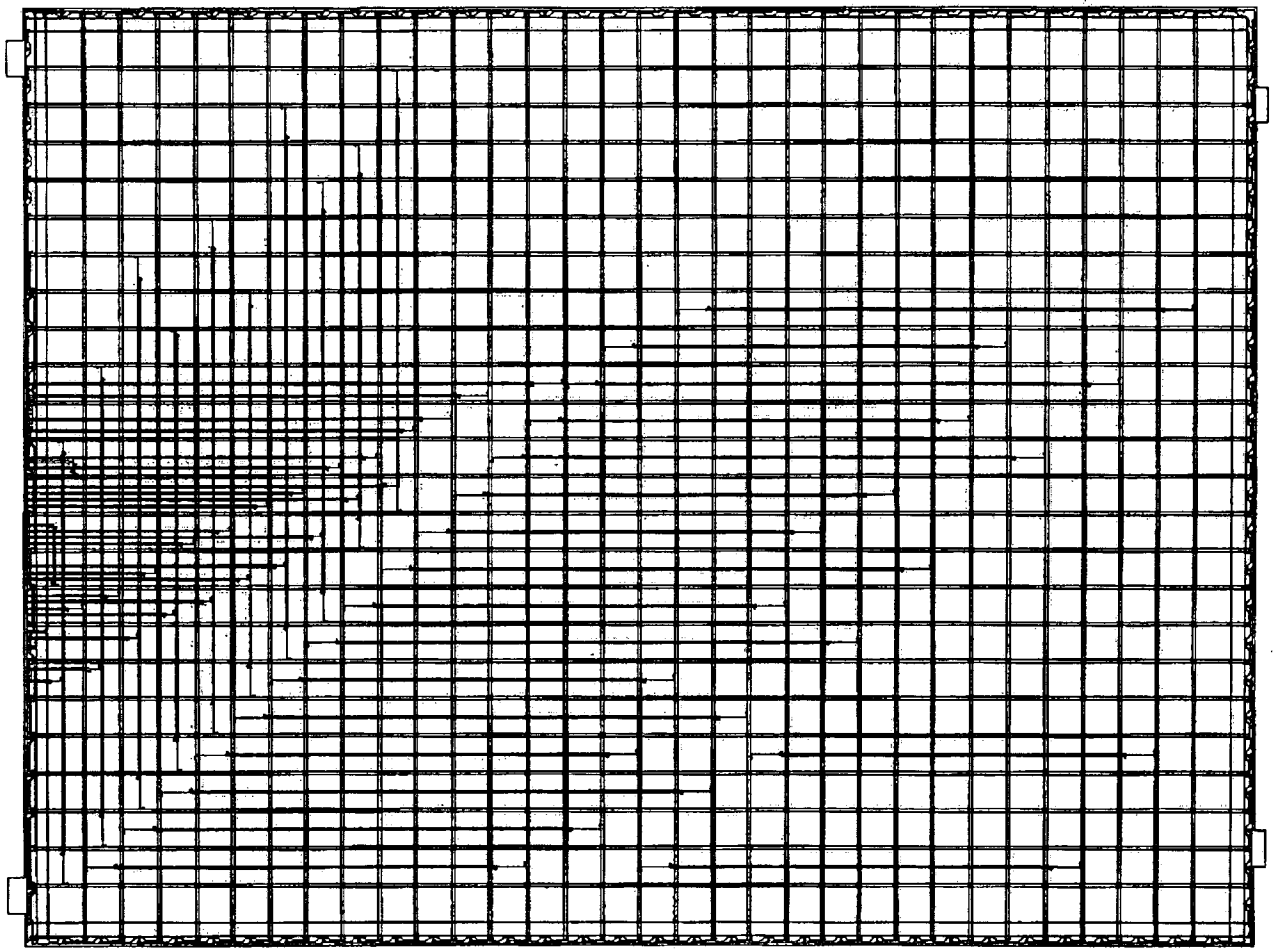
FIG. 1C(Prior Art)
FIG. 1C shows cross-sectional views illustrative of conventional antenna layout having the antenna loop with the H-shaped region in the electromagnetic-induction system.
Figure 3A:
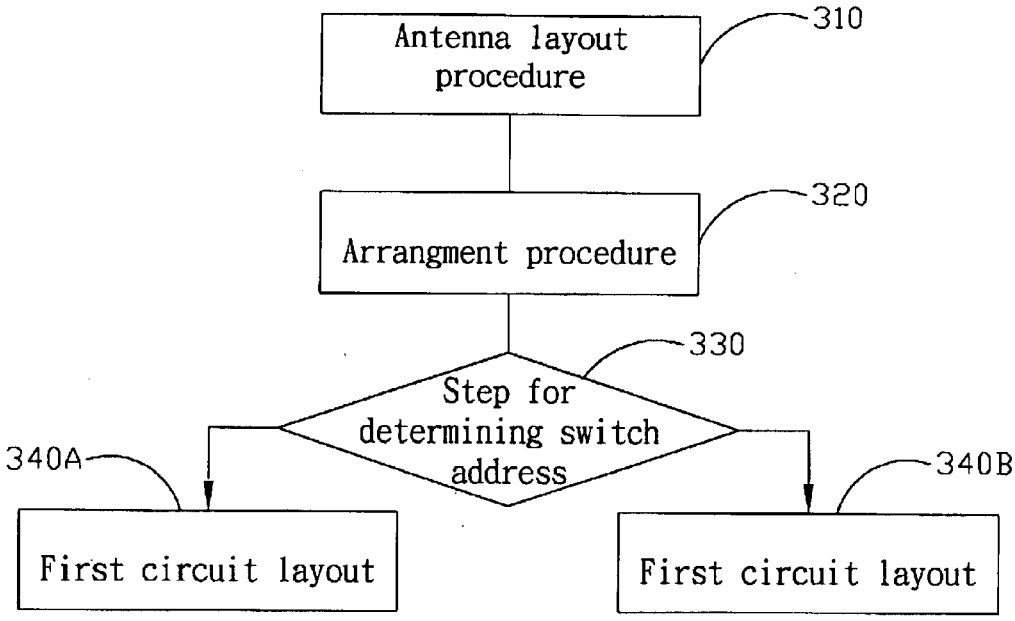
FIG. 3A shows the flowchart for the electromagnetic-induction system with the optimum antenna layout in accordance with one of the preferred embodiment.
Figure 3B:
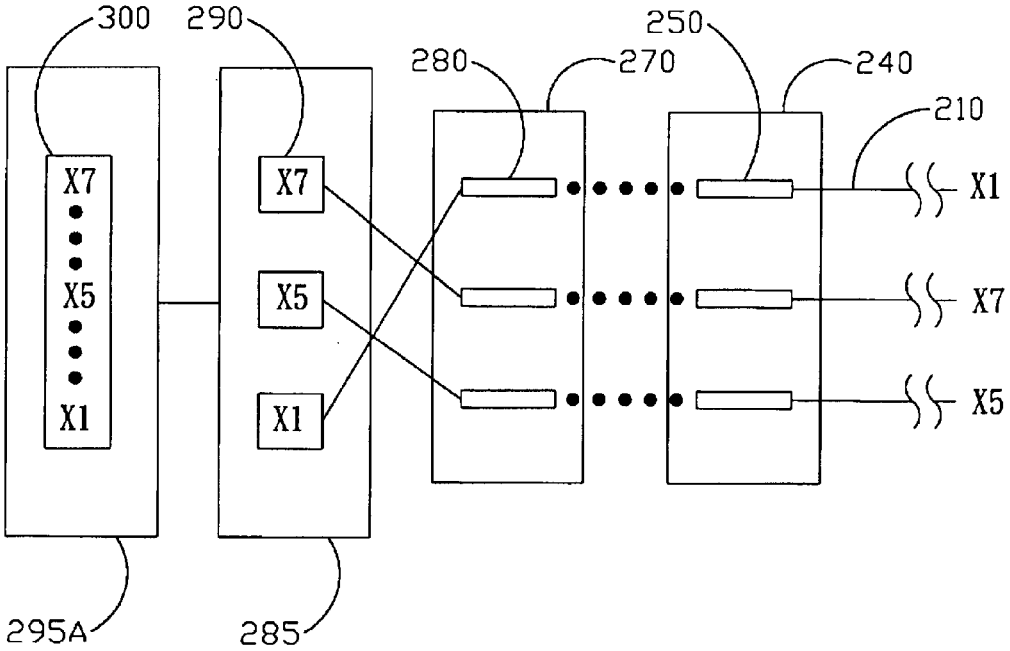
FIG. 3B and FIG. 3C show cross-sectional views illustrative of the circuit for the electromagnetic-induction system with the optimum antenna layout in accordance with one of the preferred embodiment.
Figure 3C:
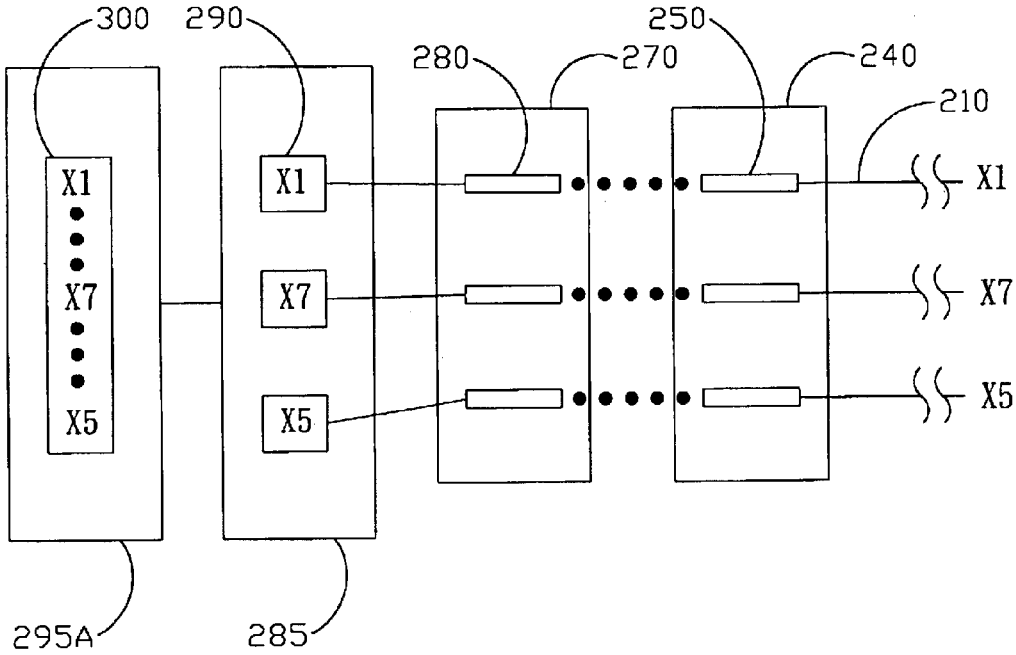

Referring now to FIG. 2A and 3A, in this preferred embodiment of the present invention, this invention also provides a method for forming the optimum antenna layout of the electromagnetic-induction system 200 as following, first of all, an antenna layout procedure 310 is performed by using an optimum program and the first antenna address to define the minimum paths of each antenna loop 220 and the position of each first pin 250 of this antenna loop 220 own, wherein the minimum path surround a critical electromagnetic-induction region that further comprises a region with h-shaped profile. Continuously, an arrangement procedure 320 is performed to define the second antenna address in the antenna-address table 300 and store it in the firmware 295A of the control sub-circuit 295, wherein the serial numbers in the first antenna address are equal to the serial numbers of the second antenna address. Afterward, the step 330 for determining switch address is performed to define the antenna addresses where are the plurality of the antenna switches located on, wherein the position of each second pin 280 is opposite the position of each first pin 250 in order. Finally, if the serial numbers of the second antenna address in the antenna-address table 300 is regularity, as shown in FIG. 1B, that is, the arrangement of the serial numbers of the second antenna address is different from the arrangement of the serial numbers of the first antenna address, so it is necessary to perform a first circuit layout 340A such that each antenna switch 290 can be coupled with each second pin 280, as shown in FIG. 3B, wherein the serial number of each antenna switch 290 is the same with each second pin 280, and the position of each antenna switch 290 is different from the position of each second pin 280; if the serial numbers of the second antenna address in the antenna-address table 300 is irregularity, as shown in FIG. 2B, that is, the arrangement of the serial numbers of the second antenna address is the same with the arrangement of the serial numbers of the first antenna address, so it is necessary to perform a second circuit layout 340B such that each antenna switch 290 can be coupled with each second pin 280, as shown in FIG. 3C, wherein the serial number of each antenna switch 290 is the same with each second pin 280, and the position of each antenna switch 290 is opposite to the position of each second pin 280.

In this embodiment of the present invention, as discussed above, this invention utilizes the design rule with minimum path to design the antenna layout so as to reduce the across-line effect, and it also makes changes in antenna address to design the optimum antenna layout. Accordingly, the conventional antenna layout uses the H-shaped antenna loop as shown in FIG. 1A, but the optimum antenna layout of the present invention uses the h-shaped antenna loop, as shown in FIG. 2A, that obviously decreases unnecessary n-type seconds as compared with the H-shaped antenna loop. Furthermore, the design in conventional antenna layout will result in the across-line effect too much such that the space between the antenna loops is narrower more and more, so it is difficult to shrink the dimension of the printed circuit board (PCB), and that it is very easy to result in the short circuit or the large noises. On the contrary, the optimum antenna layout of the present invention, as shown in FIH.2C, it succeeds in preventing from the across-line effect such that the space between the antenna loops is become wider more and more, and thus, the dimension of the printed circuit board (PCB) can be efficiently shrunk, and that the shot circuit and noises resulted from decrement of the dimension can also be avoided. Moreover, in conventional electromagnetic-induction system, the antenna loops of antenna layout are controlled by single connector with large area, this connector usually is mounted on the peripheral region of the printed circuit board( PCB), so that it must consume the larger peripheral area of the printed circuit board (PCB) to place this connector with large area. On the contrary, in this invention, the plurality of little connectors with small area substitute for the single connector with large area to disperse the connected position of each antenna, whereby the peripheral region of the printed circuit board (PCB) can be decreased, and the production time is also reduced for achieving the product size reduction target. Accordingly, this invention can strengthen efficiency of the electromagnetic-induction system. Therefore, the present invention satisfies the economical efficiency and industrial utility.

Although a specific embodiment has been illustrated and described, it will be obvious to those skilled in the art that various modifications may be made without departing from what is intended to be limited solely by the appended claims. Obviously, many modifications and variations of the present invention are possible in light of the above teachings. It is therefore to be understood that within the scope of the appended claims, the present invention may be practiced otherwise than as specifically described herein.

What is claimed is:

1. An optimum antenna layout of the electromagnetic-inductive system, the optimum antenna layout comprising:

at least a ground wire;

a plurality of connectors and plurality of pins in each of said connectors, wherein said plurality of pins are arranged in order by using an antenna-address table; and a plurality of antenna loops, said plurality of antenna loops formed between said plurality of pins of said connectors and said ground wire, and said plurality of antenna loops coupled with said plurality of connectors via said plurality of pins, wherein each of said antenna loop a plurality of n-type sections and a minimum path.

2. The optimum antenna layout according to claim 1, wherein said minimum path comprises a critical electromagnetic-induction region among the surrounding along each of said pins of each of said antenna loops to said ground wire.

3. The optimum antenna layout according to claim 2, wherein said critical electromagnetic-induction region comprises an h-shaped region.

4. An electromagnetic-inductive system with an optimum antenna layout, the electromagnetic-inductive system comprising:

an antenna loop module having a plurality of antenna loops, each of said antenna loops having a minimum path, wherein said plurality of antenna loops are arranged by a first antenna address; and a control module having a switch sub-circuit and a control sub-circuit, said control module coupled with said antenna loop module, wherein said switch sub-circuit is individually communicated with said plurality of antenna loops and said control sub-circuit, and said control sub-circuit has a table with a second antenna address to control said switch sub-circuit to perform the scanning procedure for said plurality of antenna loops.

5. The electromagnetic-inductive system according to claim 4, wherein said antenna loop module comprises a plurality of first connectors and at least one ground wire, wherein each of said first connectors has a plurality of first pins.

6. The electromagnetic-inductive system according to claim 5, wherein each of said antenna loops is coupled with said each first connector via said each first pin.

7. The electromagnetic-inductive system according to claim 4, wherein each of said antenna loops comprises a plurality of n-type sections.

8. The electromagnetic-inductive system according to claim 4, wherein said minimum path is a critical electromagnetic-induction region among the surrounding along each of said first pins of each of said antenna loops to said ground wire.

9. The electromagnetic-inductive system according to claim 8, wherein said critical electromagnetic-induction region comprises an h-shaped region.

10. The electromagnetic-inductive system according to claim 4, wherein said control module comprises a plurality of second connectors coupled with said antenna loop module, wherein each of said second connectors has a plurality of second pins, and said plurality of second pins are individually coupled with said switch sub-circuit and said antenna loop module.

11. The electromagnetic-inductive system according to claim 10, wherein said switch sub-circuit comprises a plurality of antenna switches, wherein each of said antenna switches is coupled with each of said second pins.

12. The electromagnetic-inductive system according to claim 11, wherein the designed arrangement of said plurality of antenna switches comprises said first antenna address.

13. The electromagnetic-inductive system according to claim 11, wherein the designed arrangement of said plurality of antenna switches comprises said second antenna address.

14. The electromagnetic-inductive system according to claim 4, wherein said control sub-circuit comprises a firmware used to store said table with said second antenna address.

15. An electromagnetic-inductive system with an optimum antenna layout, the electromagnetic-inductive system comprising:

a plurality of first connectors having a plurality of first pins, said plurality of first pins arranged by a first antenna address;

at least one ground wire;

a plurality of antenna loops, each of said antenna loops formed between each of said first pins and said ground wire, and said plurality of antenna loops coupled with said plurality of first connectors via said plurality of first pins, wherein each of said antenna loops has an minimum electromagnetic-induction path;

a control sub-circuit having a table with a second antenna address;

a plurality of second connectors having a plurality of second pins, said plurality of second pins of plurality of second connectors coupled with said plurality of first pins of said plurality of first connectors in order; and a switch sub-circuit, said switch sub-circuit individually coupled with said plurality of second connectors and said control sub-circuit, said control sub-circuit controls said switch sub-circuit by said table with said second antenna address for performing the scanning procedure of said plurality of antenna loops.

16. The electromagnetic-inductive system according to claim 15, wherein said minimum electromagnetic-induction path is formed by a plurality of n-type sections.

17. The electromagnetic-inductive system according to claim 15, wherein said minimum electromagnetic-induction path is a critical electromagnetic-induction region among the surrounding along each of said first pins of each of said antenna loops to said ground wire.

18. The electromagnetic-inductive system according to claim 17, wherein said critical electromagnetic-induction region comprises a h-shaped region.

19. The electromagnetic-inductive system according to claim 15, wherein said control sub-circuit comprises a firmware for storing said table with said second antenna address.

20. The electromagnetic-inductive system according to claim 15, wherein the amount of said plurality of second connectors is equal to the amount of said plurality of first connectors, and the amount of said plurality of second pins in each of said second connectors is equal to the amount of said plurality of first pins in each of said first connectors.

21. The electromagnetic-inductive system according to claim 15, wherein said switch sub-circuit comprises a plurality of antenna switches that are arranged by said first antenna address, wherein said plurality of antenna switches are coupled with said plurality of second connectors by a first circuit layout.

22. The electromagnetic-inductive system according to claim 21, wherein the designed arrangement in said second antenna address of said table is difference from the designed arrangement in said first antenna address.

23. The electromagnetic-inductive system according to claim 15, wherein said switch sub-circuit comprises a plurality of antenna switches that are arranged by said second antenna address, wherein said plurality of antenna switches are coupled with said plurality of second connectors by a second circuit layout.

24. The electromagnetic-inductive system according to claim 23, wherein the designed arrangement in said second antenna address of said table is the same with the designed arrangement in said first antenna address.

* * * * *